United States Patent [19]

Davis

[11] Patent Number: 4,902,243

[45] Date of Patent: Feb. 20, 1990

[54] HIGH DENSITY RIBBON CABLE CONNECTOR AND DUAL TRANSITION CONTACT THEREFOR

[75] Inventor: Wayne S. Davis, Harrisburg, Pa.

[73] Assignee: AMP Incorporated, Harrisburg, Pa.

[21] Appl. No.: 303,798

[22] Filed: Jan. 30, 1989

[51] Int. Cl.[4] ..... H01R 4/24

[52] U.S. Cl. ..... 439/405; 439/417

[58] Field of Search ..... 439/389–426

[56] References Cited

U.S. PATENT DOCUMENTS

| | | | |
|---|---|---|---|
| 4,252,397 | 2/1981 | Eigenbrode et al. | 439/405 |
| 4,359,257 | 11/1982 | Lopinski et al. | 439/405 |
| 4,418,977 | 12/1983 | O'Shea | 339/99 |
| 4,464,002 | 8/1984 | Suzuki | 339/97 |
| 4,655,528 | 4/1987 | Groft | 339/99 |
| 4,684,197 | 8/1987 | Reichardt | 439/404 |
| 4,773,876 | 9/1988 | Nakamura et al. | 439/417 |

*Primary Examiner*—Joseph H. McGlynn
*Attorney, Agent, or Firm*—David L. Smith

[57] ABSTRACT

An electrical terminal (32) for insertion into a passage (30) in a dielectric housing (22) or a high density ribbon cable connector (20) incorporating the terminal is disclosed. The high density ribbon cable connector (20) has an insulative housing (22) having passages (30) extending therethrough. Each of the passages (30) have an electrical terminal (32) secured therein. Each terminal (32) has a mating section (34), an intermediate section (56) and an insulation displacement section (38). A first transition section (60) is disposed between the mating section (34) and the intermediate section (56); a second transition section (72) is disposed between the intermediate section (56) and the insulation displacement section (38). The intermediate section (56) provides forwardly facing stop shoulders (58) for engagement with stop shoulders (64) in the insulative housing (22) to position the terminal (32) in a passage (30). Each terminal (32) is pushed into a passage (30) in the housing (22) by applying an insertion force on rearwardly facing shoulders (65) on the intermediate section (40). The first transition section (60) provides that the forwardly facing stop shoulders (58) on the intermediate section (46) are not in the same plane as the mating section (34) of the terminal (32). The second transition section (72) positions the insulation displacement section (38) out of the plane of the rearwardly facing insertion force shoulders (65). A termination cover (24) is used to press the ribbon cable (94) onto the insulation displacement sections (38) of the terminals (32), thereby terminating the conductors (92) of the ribbon cable (94) to respective terminals (32).

25 Claims, 8 Drawing Sheets

HIGH DENSITY RIBBON CABLE CONNECTOR AND DUAL TRANSITION CONTACT THEREFOR

BACKGROUND OF THE INVENTION

This invention relates to electrical connectors and contacts therefore and, in particular, to a high density ribbon cable connector and a dual transition contact therefore.

As printed circuit board components are down-sized, the printed circuit board area allocated for connectors is also decreased. As the smaller area is utilized, more contacts are placed in smaller and smaller connectors. The complementary connectors, typically a ribbon cable connector, must also contain a higher density of contacts. As the density of contacts in ribbon cable connectors increases, the spacing between adjacent conductors in ribbon cable decreases correspondingly. As the spacing between conductors in the ribbon cable decreases, the likelihood of adjacent contacts making electrical engagement with each other increases with the result that contacts must be designed to assure there is dielectric housing material separating the contacts.

SUMMARY OF THE INVENTION

In accordance with the present invention, an electrical terminal for insertion into a passage in a dielectric housing or a high density ribbon cable connector incorporating the terminal is disclosed. The high density ribbon cable connector has an insulative housing having a plurality of passages extending therethrough. Each of the passages has an electrical terminal secured therein. Each terminal has a mating section, an intermediate section and an insulation displacement section. A first transition section is disposed between the mating section and the intermediate section; a second transition section is disposed between the intermediate section and the insulation displacement section. The intermediate section provides forwardly facing stop shoulders for engagement with stop shoulders in the insulative housing to position the terminal in the passage in which it is inserted. Each terminal is pushed into a passage in the housing by applying an insertion force on rearwardly facing shoulders on the intermediate section. The first transition section provides that the forwardly facing stop shoulders on the intermediate section are not in the same plane as the mating section of the terminal. A second transition section is disposed between the intermediate section and the insulation displacement section. The second transition section provides that the insulation displacement section is not in the same plane as rearwardly facing insertion force shoulders also on the intermediate section. A latching termination cover is used to press the ribbon cable onto the insulation displacement sections of the terminals, thereby terminating the conductors of the ribbon cable to respective terminals.

DESCRIPTION OF THE PREFERRED EMBODIMENT

Figure 1:
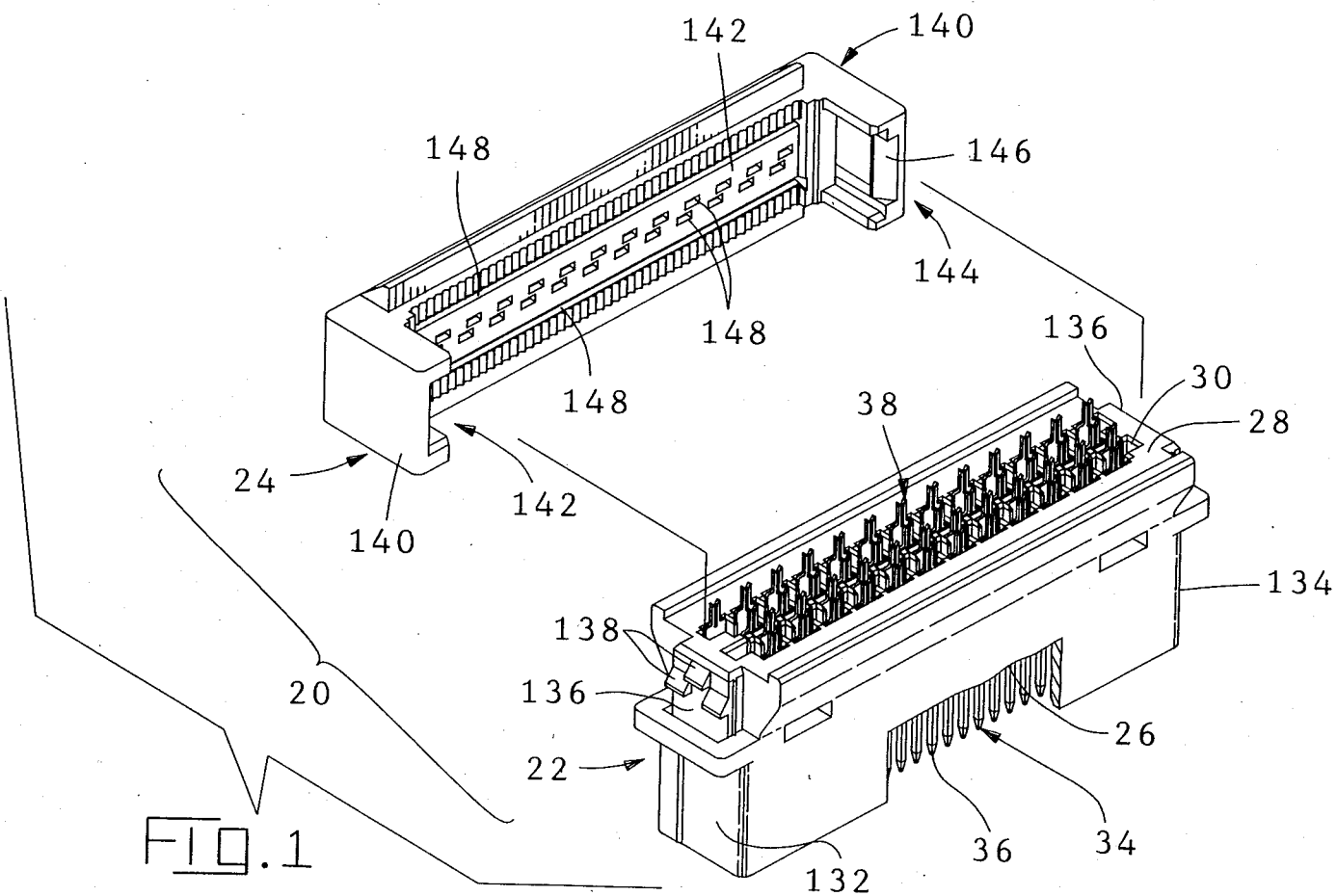
FIG. 1 is a perspective view of a high density ribbon cable connector, in accordance with the invention, with the terminating cover exploded from the connector housing and with the housing partially cut away.

A high density ribbon cable connector 20 in accordance with the present invention is shown in a perspective view in FIG. 1. Although connector 20 is shown as an unshielded connector, it could be a shielded connector. Connector 20 includes housing 22 and termination cover 24, both molded of a dielectric material. Housing 22 has forward mating face 26, opposed conductor receiving rear face 28 and contact receiving passages 30 extending therebetween, with contacts 32 secured therein. In the preferred embodiment, contacts 32 are positioned in housing 22 with the mating portion 34, in the form of tab 36, in two rows spaced with centerlines 0.100 inch (2.5 mm) apart, with adjacent tabs in each row spaced with centerlines 0.050 inch (1.27 mm) apart, however the inventions is not limited to these contact spacings.

Figure 2:
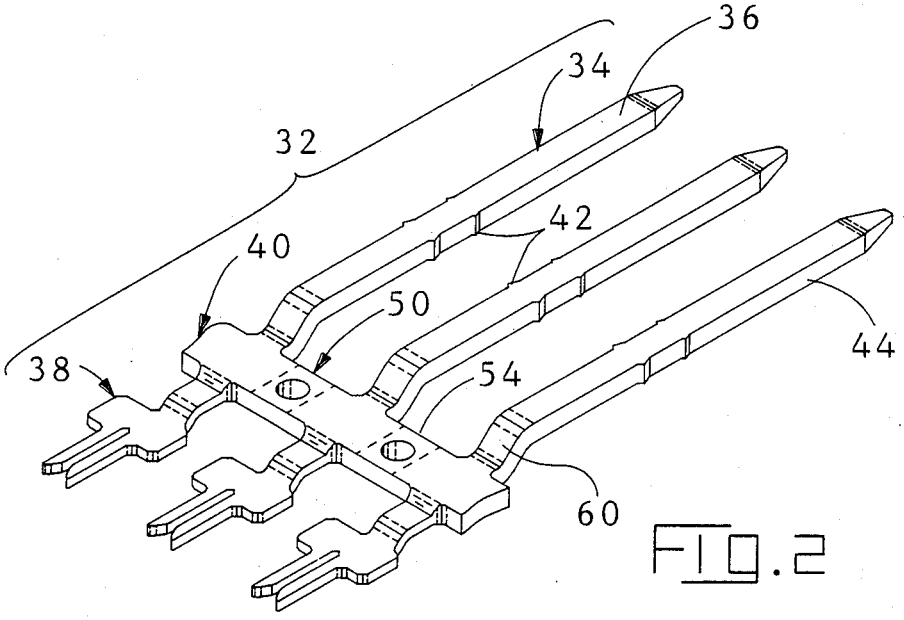
FIG. 2 is a perspective view of terminals in accordance with the present invention carried on a carrier strip.
Figure 3:
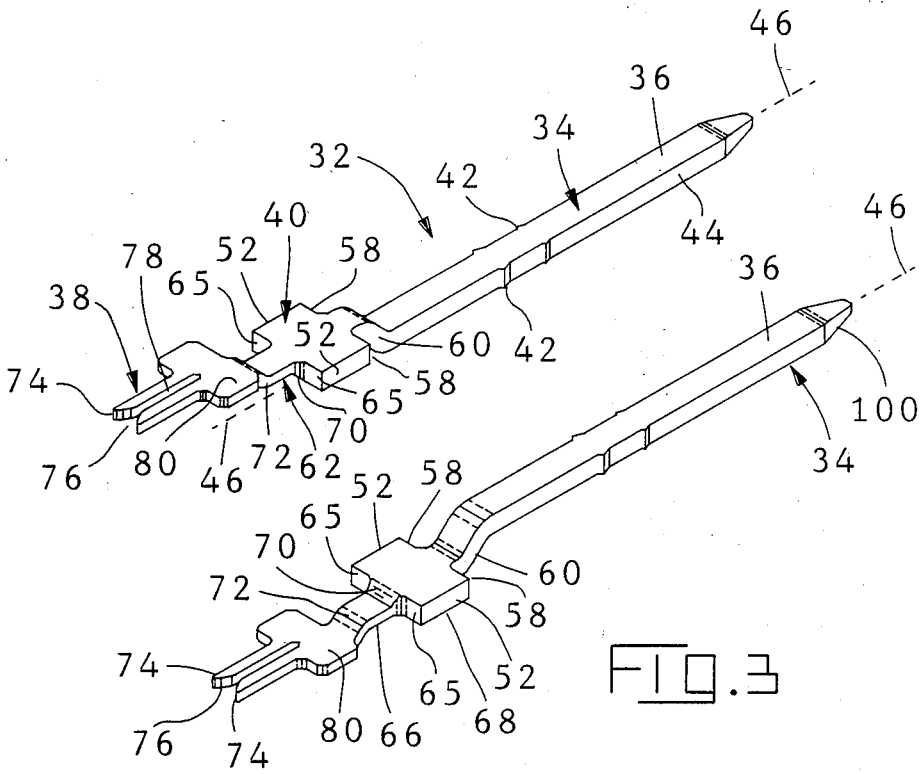
FIG. 3 is a perspective view of the two types of contacts disclosed in the preferred embodiment.

Contacts 32, as best seen in FIGS. 2 and 3, are stamped and formed from rolled strip stock, typically phosphorus bronze. A portion of the width of the rolled stock is pre-milled to provide a thinner region along an edge of the strip stock. Each contact 32 has a mating portion 34 at one end, an insulation displacement plate 38 at the other end, and an intermediate portion 40 therebetween. The mating portion 34 of each contact 32 is stamped in the thicker portion of the stock; the insulation displacement plate 38 is stamped in the thinner region of the stock.

Mating portion 34 comprises tab 36 having barbs 42 on side edges 44 thereof, and defining axis 46 therethrough. Upon insertion of contact 32 into a passage 30, barbs 42 plow through passage sidewalls 48 (see FIG. 6) with plastic flowing around the barbs to provide an interference fit that secures tab 36 and hence contact 32 in passage 30. The intermediate portion 40 of contact 32 comprises a portion of the carrier strip 50. When contact 32 is severed from carrier strip 50, laterally facing sheared edge surfaces 52 are formed. The section 54 of the carrier strip between adjacent edge surfaces 52 of adjacent contacts 32 may have feed holes and is discarded. The section of the carrier strip that remains on each contact 32 comprises intermediate portion 40 and extends laterally, typically beyond tab 36, providing forward facing stop shoulders 58. In a preferred embodiment, tab 36 is off-set from the plane of the stock, which is the plane of carrier strip 50 and section 54, in a first direction, resulting in a first transition region 60 providing a first off-set.

Insulation displacement plate 38 is thinner to facilitate insulation displacement termination of ribbon cable 94 by reducing the force necessary to effect a termination. Insulation displacement plate 38 extends from section 56 on extension 62. Section 56 extends laterally, typically beyond extension 62, providing rearwardly facing stop shoulders 65 (see FIG. 6). When contacts 32 are inserted into housing 22, the insertion force is applied to shoulders 65 and hence the thicker portion of the contact to push contacts into respective passages 30. The insertion force overcomes the resistance to insertion incurred by barbs 42 providing an interference fit with walls 48. First transition region 60 provides that the forwardly facing stop shoulders 58 on section 56 are not in the same plane as the mating portion 34 of contact 32.

A first surface 66 of extension 62 extends coplanar with a first surface 68 of section 56. Ramped surface 70 on the opposing side of extension 62 makes the transition from the thicker stock of tab 36 and section 56 to the thinner, pre-milled stock of insulation displacement plate 38.

In a preferred embodiment, insulation displacement plate 38 is off-set at second transition region 72 from section 56 in the same direction that section 56 is off-set from tab 36, with insulation displacement plate 38 substantially parallel to section 56. Second transition region 72 provides that the insulation displacement plate 38 is not in the same plane as rearwardly facing shoulders 65.

Insulation displacement plate 38 extends to a pair of insulation piercing points 74 at the distal end spaced approximately as the centerline spacing of conductors in the ribbon cable to be terminated. Tapered lead-in surfaces 76 angle toward conductor receiving slots 78. Slot 78 extends into a widened base region 80 of plate 38 which begins about halfway along slot 78. Slot 78 is substantially parallel to axis 46 and laterally displaced therefrom.

Second transition region 72 provides an insulation displacement plate 38 that is out of the plane of section 56 such that an insertion tool can engage rearwardly facing shoulders 65 to apply an insertion force to push contacts 32 into passages 30 of housing 22. The insertion tool in the preferred embodiment would bridge extension 62 and ramped surface 70. Without the second transition region 72 it would be more difficult to apply an insertion force to shoulders 65.

Figures 4, 5:
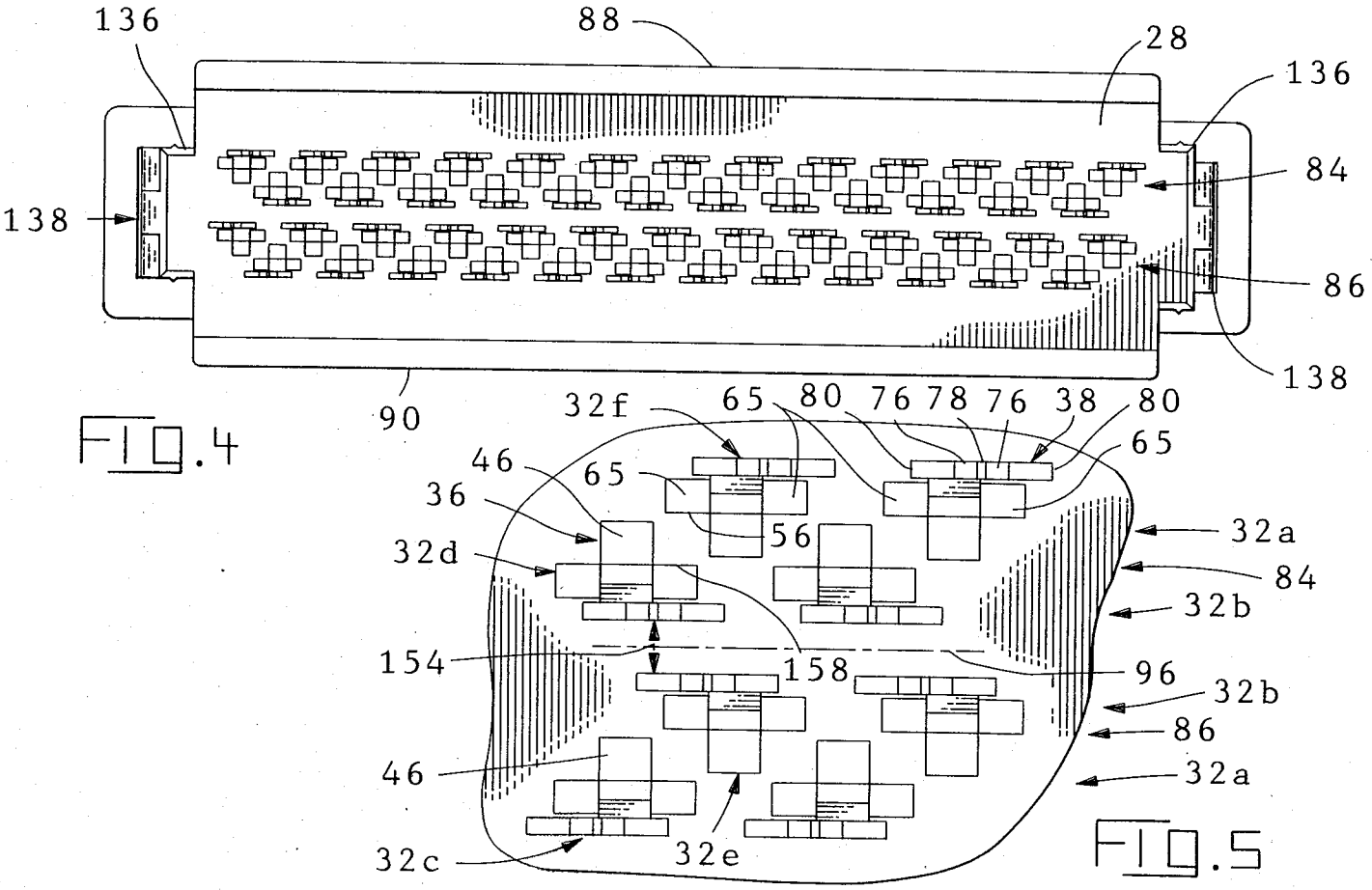
FIG. 4 is a view of the connector housing showing the conductor receiving face.
FIG. 5 is an enlargement of a portion of FIG. 4.

As best seen in FIGS. 3, 5, 7 and 8, there are two types of contacts 32 with the general features described above. Contact **32*a* will be referred to as an outside contact as insulation displacement plate 38 of contacts 32*a* form the two outer rows of insulation displacement plates, as seen in FIGS. 4 and 5. Contact 32*b* will be referred to as an inside contact, as insulation displacement plate 38 of contact 32*b* forms the two inner rows of insulation displacement plates in FIGS. 4 and 5**.

In the preferred embodiment, the mating portion of outer row of contacts **32*a* and the mating portion of adjacent inner row of contacts 32*b* form a first row 84 of tabs 36. Similarly, the mating portion of the other outer row of contacts 32*a* and the mating portion of the adjacent inner row of contacts 32*b* form a second row 86 of tabs 36**.

Due to the high contact density, that is the closeness of the spacing between contacts 32 and the relative width of base region 80, if the insulation displacement plates 38 were not offset from the mating portion of contacts 32 such as towards side wall 88,90, the lateral edges of base region 80 of adjacent contacts would engage, thereby shorting out. Even if the lateral edges did not engage, dielectric material separating adjacent contacts may not provide sufficient dielectric material to withstand voltages to be practical. The dual transitions between mating portion 34 and insulation displacement plate 38 provides for a greater inter-insulation displacement plate spacing which minimizes the potential arcing between contacts.

The outer contacts **32*a* in row 84 are identical to the outer contacts 32*a* in row 86, the outer contacts 32*a* in row 86 being rotated 180 degrees around axis 46. The inner contacts 32*b* in row 84 are identical to the inner contacts 32*b* in row 86, the contacts 32*b* in row 86 being rotated 180 degrees around axis 46. In the preferred embodiment, the insulation displacement plate 38 of inside contacts 32*b* is offset inwardly toward the interior of the connector housing from the axis 46 of tab 36. The insulation displacement plate 38 of the outside contacts 32*a* is offset outwardly toward side walls 88,90 from axis 46 thereof. The conductor receiving slot 78 in contacts 32 is offset laterally from axis 46. The offset is one-half of the centerline spacing of conductors 92 in ribbon cable 94. The preferred embodiment's connector is described to be terminated to a ribbon cable 94 having conductor 92** centerline spacing of 0.025 inch (0.635 mm). Thus, the lateral offset in the preferred embodiment is 0.0125 inch (0.317 mm).

The insulation displacement plates of terminals **32*c*, 32*d*, 32*e* and 32*f* terminate four adjacent conductors in ribbon cable 94. Adjacent conductors in the ribbon cable, thus being terminated, are conductive with the mating portion 34 of adjacent contacts across centerline 96. Thus, if the conductors of the ribbon cable alternately carry a signal, ground, signal, ground, etc., all ground conductors are terminated to contacts such that all mating portions 34 in a row 84 carry a ground while all mating portions 34 in a row 86** carry signals.

As seen in FIG. 5, slot 78 is offset one-half of the centerline spacing to the left of axis 46 of contact **32*c*. A line segment interconnecting the axes of contacts 32*c* and 32*d* is normal to the centerline 96 of face 28. Slot 78 is offset one-half of the centerline spacing to the right of axis 46 of contact 32*d*. As stated above, the centerline spacing between axes 46 of contacts 32*d* and 32*f*** is 0.050 inches (1.27 mm).

A line segment interconnecting the axes of contacts **32*e* and 32*f* is normal to centerline 96. Slot 78 is offset one-half of the centerline spacing to the right of axis 46 of contact 32. Slot 78 is offset one-half of the centerline spacing to the left of axis 46 of contact 32*e*. It can thus be seen that slots 78 of contacts 32*c*, 32*d*, 32*e* and 32*f*** are spaced to correspond to the centerline spacing of the conductors of a ribbon cable adapted to be terminated thereon.

Figure 7:
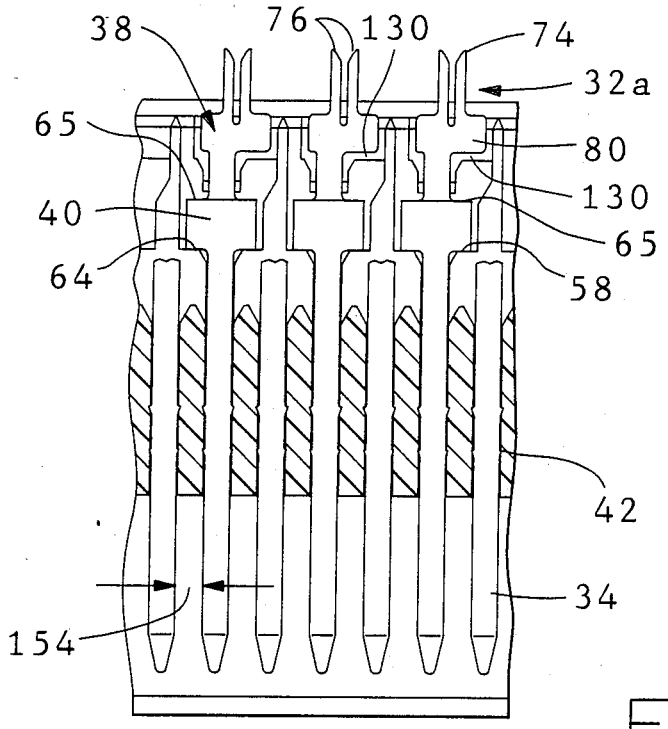
FIG. 7 is a top view of a row of the first type of contacts in a cut-away housing.
Figure 8:
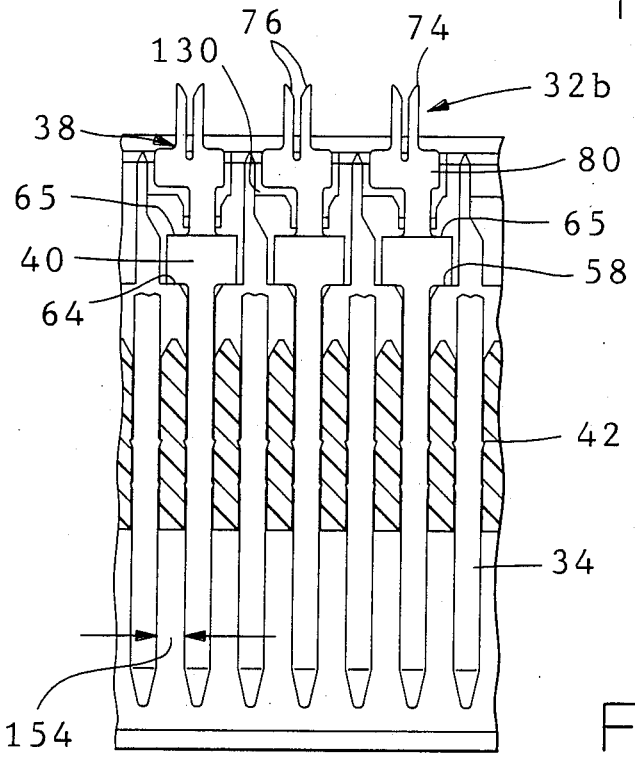
FIG. 8 is a top view of a row of the second type of contacts in a cut-away housing.

In the preferred embodiment, passage 30 for either an inside or an outside contact is virtually identical, as seen in FIGS. 7 and 8. The differences are that for an outside contact, the passage offsets outwardly toward a side wall of housing 22 whereas for an inside contact, the passage offsets inwardly toward centerline 96. Furthermore, ribs 104 are on wall 106 for all contacts and allowance is made for base 80 to be offset such that slot 78 is offset laterally from axis 46 in opposite directions for inside and outside contacts, as best seen in FIGS. 7 and 8.

The spacing between side edges 44 of adjacent tabs 36 in a row of tabs 84 or 86 is the minimum distance 154 between any two points of any features of adjacent contacts in a row 84 or 86. As seen in FIGS. 7 and 8, all features of inside contacts are maintained spaced from adjacent inside contacts at least the minimum distance 154. Likewise, all features of outside contacts are maintained spaced from adjacent outside contacts at least the minimum distance 154. The dual offsets provided by first transition region 60 and second transition region 72 assure that all features of intermediate portion 40 and insulation displacement plate 38 of adjacent inside and outside contacts remain at least the minimum distance 154 apart. Thus, where a projection of a feature of adjacent contacts overlies each other, they are at least the minimum distance 154 apart, for example, the corners 156 and 158 of intermediate portion 40 of contacts 32 as best seen in FIG. 6.

The spacing between the closest points of inside contacts 32*b* cross centerline 96, as best seen in FIG. 5, is also maintained at least minimum distance 154 apart.

Figure 6:
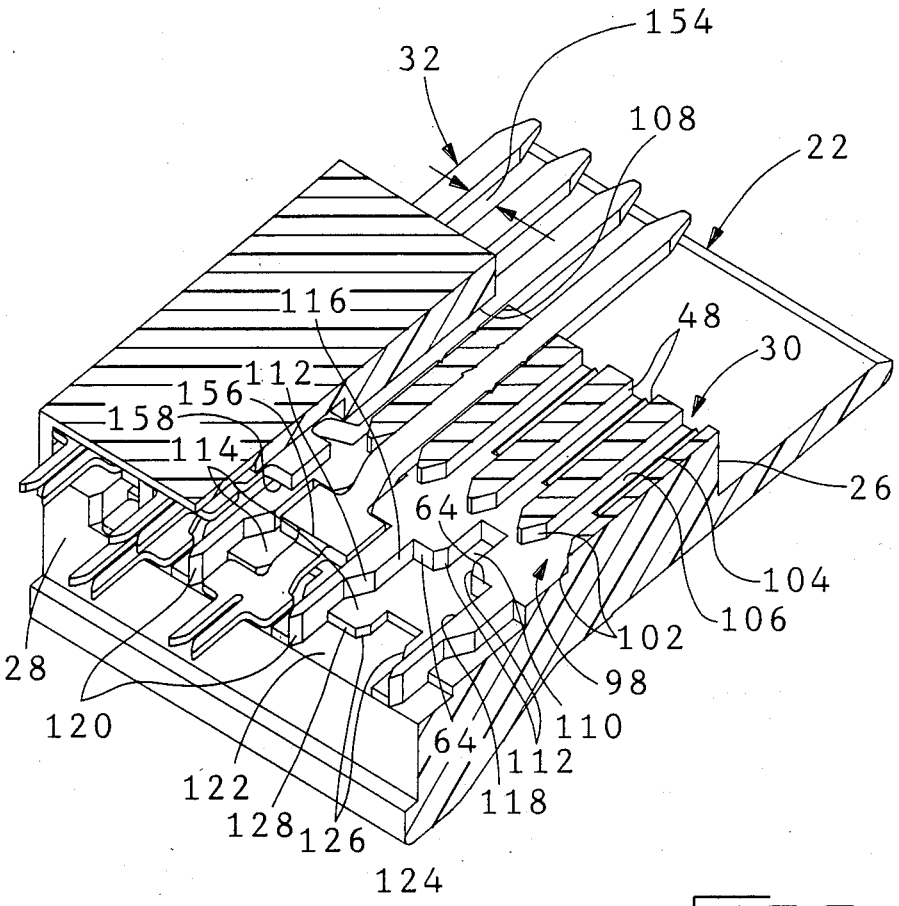
FIG. 6 is a perspective view of the housing of a connector, partially cut away, showing a contact positioned in the housing and the housing structure for receiving a contact.

FIG. 6 shows a cutaway view of a part of housing 22 showing detailed features of passage 30. Tab 36, upon insertion into a respective passage 30, is guided into the narrower forward portion 98 by cooperating tapered end 100 and tapered lead-in surfaces 102 which laterally position tab 36 for entry into forward portion 98. Tab 104 protruding inward along the forward portion of passage wall 106 forces tab 36 against the opposite passage wall 108 to minimize the position tolerance of tabs 36.

First transition region 60 provides the transition from narrow forward portion 98 to recess 110. Tapered lead-in surfaces 112 facilitate first transition region 60 entering recess 110 and permit a radius on contact 32 between tab 36 and section 56.

During insertion of a contact into a contact receiving passage 30, forwardly facing shoulders 58 seat against rearwardly facing shoulders 64 to precisely position contact 32 in passage 30. Thus, shoulders 58 provide a datum on contacts 32 relative to which all contact structure is referenced. Similarly, shoulders 64 provide a datum on housing 22 relative to which structure along passage 32 is referenced.

Surface 68 of section 56 engages a wall 114. Lateral edge surfaces 52 extend between the clear walls 116,118 Walls 116 and 118 extend rearwardly to tapered lead-ins 120, with wall 116 offset at tapered lead-in 122.

Second transition region 72 provides a transition from section 56 engaging wall 114 to base region 80 engaging a wall 123. Second transition region 72 is received in recess 124. Tapered lead-in !26 guides second transition region 72 into recess 124 during insertion of a contact 32 into passage 30. With a contact 32 positioned in passage 30, there is a small amount of clearance between shoulders 128 and base 80 as at 130. Shoulders 128 support base 80 during termination of cable 94.

Figure 9:
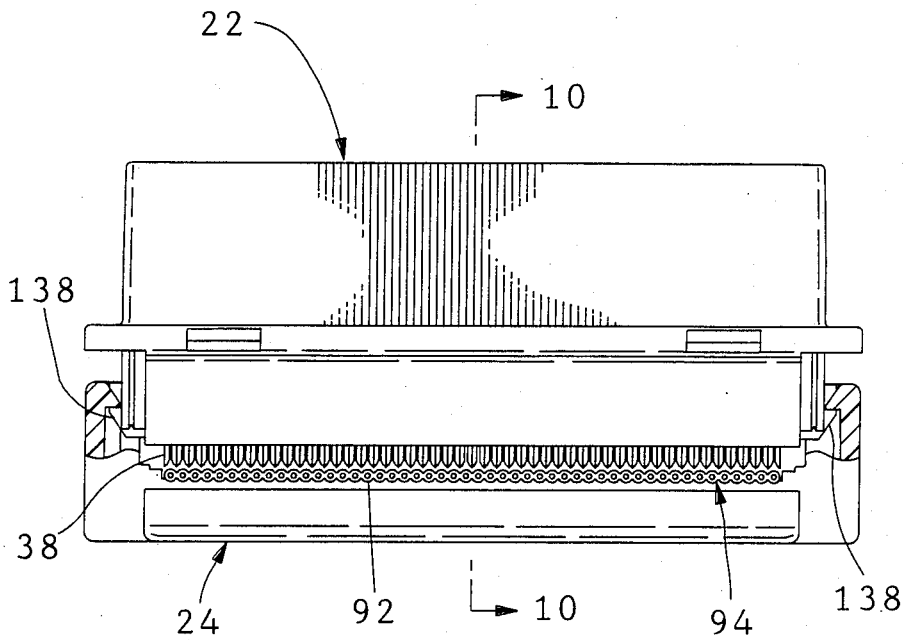
FIG. 9 is a side view, partially sectioned, of the connector with a ribbon cable positioned to be terminated and the termination cover in a pre-termination position.
Figure 10:
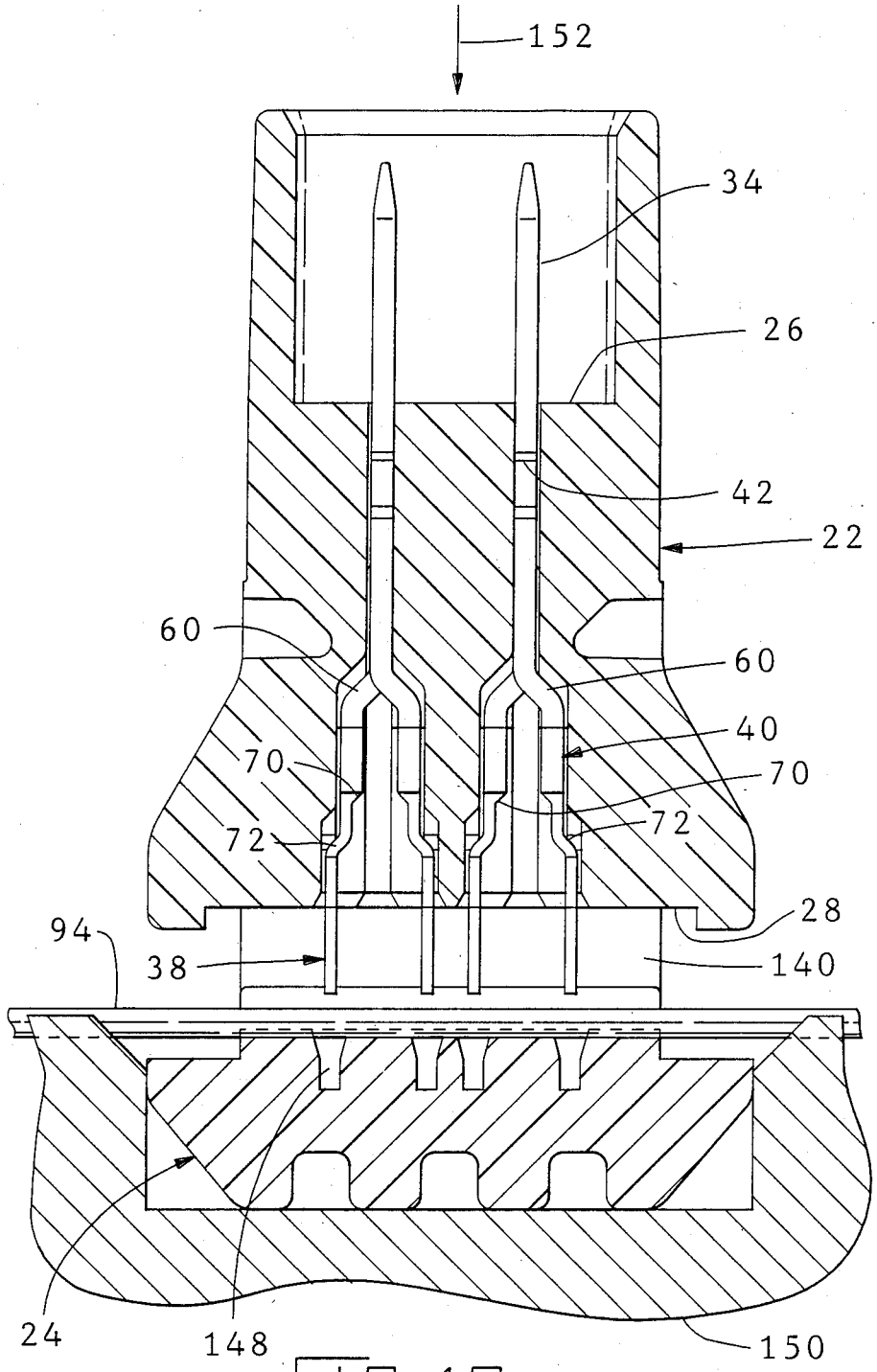
FIG. 10 is an end sectional view of the connector of FIG. 9, taken along the lines 10—10.

Housing end walls 132, 134 have terminating cover alignment ribs 136 extending outwardly therefrom. Latch means 138 are provided on ribs 136 to cooperate with complementary latch means on terminating cover 24 to secure the terminating cover to housing 22. Terminating cover 24 is elongate, having latch arms 140 at opposite ends thereof, with an inner surface 142 extending therebetween for engaging ribbon cable 94. Latch arms 140 have a channel 144 complementary to ribs 136 which cooperates with ribs 136 during movement of termination cover 24 from a pretermination position to a termination position to guide cover 24 parallel to slots 78. Latch arms 140 also have complementary latch means 146 adapted to engage latch means 138 to retain cover 24 on housing 22. FIGS. 9 and 10 show termination cover 24 on a pretermination position wherein latch means 138 in complementary latch means 146 maintain terminating cover 24 such that inner surface 142 is spaced from insulation piercing points 74 of contacts 32 to permit insertion of a ribbon cable 94 therebetween.

During termination of ribbon cable 94 onto connector 20, terminating cover 24 may be placed in tool 150, cable 94 passed between plates 38 and inner surface 142 with conductors 92 positioned to correspond to slots 78, thence housing 22 pressed toward cover 24 as indicated by arrow 152. Conductors 92 are terminated on respective plates 38 as insulation displacement plates 38 pass into recesses 148 and inner surface 142. This provides some plastic adjacent to each recess 148 to support the insulation surrounding a conductor being terminated in a plate passing into the recess.

Figure 11:
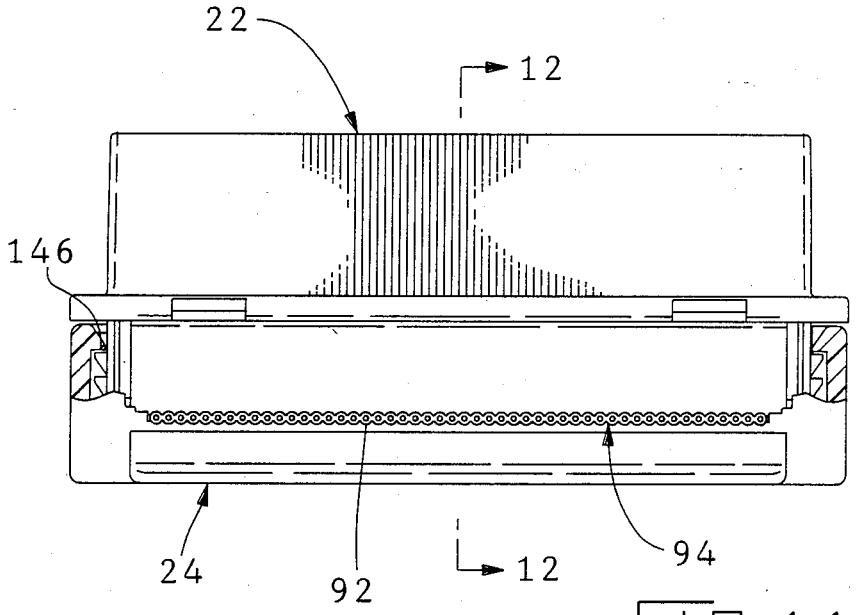
FIG. 11 is a side view, partially sectioned, of the connector with a ribbon cable terminated thereto and the termination cover in a terminated position.
Figure 12:
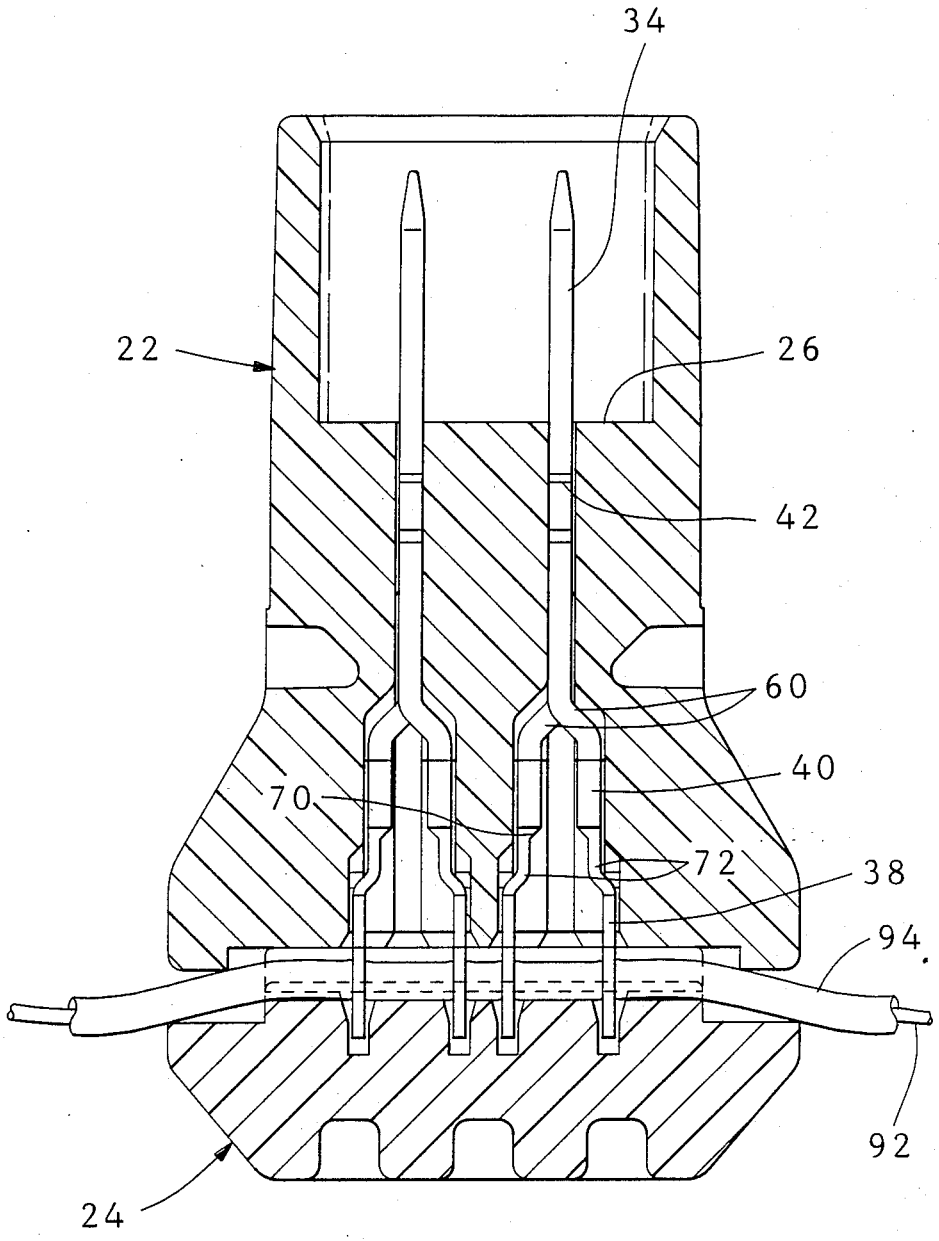
FIG. 12 is an end sectional view of the connector of FIG. 11, taken along the lines 12—12.

FIGS. 11 and 12 show terminating cover 24 having been moved from a pretermination position to a termination position with latch means 138 in complementary latch means 146 securing cover 24 to housing 22 in the terminated position.

Although the first and second transitions have been described herein above in the preferred embodiment as providing that section 56 is displaced out of the plane of mating portion 34 and plate 38 is displaced out of the plane of both section 56 and mating portion 34, it is contemplated within the scope of the invention that variations may be made. One possible variation is to provide a mating portion 34 that is substantially coplanar with a thinner insulation displacement plate 38 with intermediate portion 56 rotated 90 degrees such that the first and second transitions are a twist.

I claim:

1. A high density ribbon cable connector for terminating to a ribbon cable having close, uniformly spaced conductors surrounded by insulation, said connector comprising:

an insulative housing having a cable receiving face and a plurality of passages extending into the housing from said cable receiving face;

each of said passages having an electrical terminal secured therein, said terminal comprising a mating section, an intermediate section, an insulation displacement section, a first transition section, and a second transition section, said first transition section between the mating section and the intermediate section, said first transition section displacing the mating section from the intermediate section in a first direction, said second transition section between the intermediate section and the insulation displacement section, said second transition section displacing the insulation displacement section from the intermediate section in a second, opposite direction from the first direction, a portion of said insulation displacement section extending beyond said cable receiving face for termination thereto of the ribbon cable; and a termination cover securable to said housing, whereby when the termination cover is positioned in a pretermination position with a ribbon cable between the cover and the insulation displacement section of the terminals, pressing on the termination cover will terminate conductors of the ribbon cable to respective insulation displacement sections of said terminals.

2. A high density ribbon cable connector as recited in claim 1 wherein the intermediate section of each terminal further comprises a forwardly facing stop shoulder for engaging a stop surface in a respective passage.

3. A high density ribbon cable connector as recited in claim 1 wherein the intermediate section of each terminal further comprises a rearwardly facing shoulder on which an insertion force can be applied during insertion of said terminals into said passages.

4. A high density ribbon cable connector as recited in claim 1 wherein said first transition section offsets the mating section from the plane of the intermediate section.

5. A high density ribbon cable connector as recited in claim wherein said second transition section offsets the insulation displacement section from the plane of the intermediate section.

6. A high density ribbon cable connector as recited in claim 4 wherein said second transition section offsets the insulation displacement section from the plane of the intermediate section.

7. An electrical terminal for insertion into a passage in a dielectric housing comprising:

a mating section, an intermediate section, and an insulation displacement section, a first transition section, said first transition section between the mating section and the intermediate section, said first transition section displacing the mating section from the intermediate section in a first direction, a second transition section, said second transition section between the intermediate section and the insulation displacement section, said second transition section displacing the insulation displacement section from the intermediate section in a second, opposite direction from said first direction.

8. An electrical terminal for insertion into a passage in a dielectric housing as recited in claim 7 wherein said intermediate section further comprises a forwardly facing stop shoulder for engaging a stop surface in said passage upon insertion thereinto.

9. An electrical terminal for insertion into a passage in a dielectric housing as recited in claim 7 wherein said intermediate section further comprises a rearwardly facing shoulder on which an insertion force can be applied to push said terminal into the passage.

10. An electrical terminal for insertion into a passage in a dielectric housing as recited in claim 7 wherein said first transition section offsets the mating section from the plane of the intermediate section.

11. An electrical terminal for insertion into a passage in a dielectric housing as recited in claim 7 wherein said second transition section offsets the insulation displacement section from the plane of the intermediate section.

12. An electrical terminal for insertion into a passage in a dielectric housing as recited in claim 10 wherein said second transition section offsets the insulation displacement section from the plane of the intermediate section.

13. A high density ribbon cable connector for terminating ribbon cable having close, uniformly spaced conductors surrounded by insulation, said connector comprising:

an insulative housing having a cable receiving face and a plurality of passages extending into the housing from said cable receiving face, each said passage having a stop shoulder facing said cable receiving face;

each of said passages having an electrical terminal secured therein, said terminal comprising a mating section defining a plane, an intermediate section having forwardly facing stop means and rearwardly facing stop means, an insulation displacement section defining a plane, a first transition section and a second transition section, said first transition section between said mating section and said intermediate section to position said forwardly facing stop means out of the plane of the mating section to engage said stop shoulder, said second transition section between said intermediate section and said insulation displacement section to position said rearwardly facing stop means out of the plane of said insulation displacement section; and a termination cover securable to said housing, whereby when the termination cover is positioned in a pretermination position with a ribbon cable between the cover and the insulation displacement section of the terminals, pressing on the termination cover will terminate conductors of the ribbon cable to respective insulation displacement sections of said terminals.

14. A connector for terminating to a ribbon cable having close, uniformly spaced conductors surrounded by insulation, said connector comprising:

an insulative housing defining a cable receiving face, a first mating face and a first row of terminal receiving passages extending therebetween, each of said passages having an electrical terminal secured therein, each terminal comprising a mating section defining an axis, and wall means facing adjacent terminals in said row of terminals defining a predetermined distance therebetween, an intermediate section, an insulation displacement section, a first transition section, and a second transition section, said first transition section between the mating section and the intermediate section, said first transition section displacing the mating section from the plane of the intermediate section in an first direction normal to said row of terminal receiving passages, said second transition section between the intermediate section and the insulation displacement section, said second transition section displacing the insulation displacement section from the intermediate section in a second, opposite direction from the first direction, such that the insulation displacement section is offset from the axis of the mating portion, at least a portion of each insulation displacement section extending beyond said cable receiving face for termination thereto of the ribbon cable, alternate terminals in said row having the insulation displacement sections thereof offset from the axis of the mating portions in opposite directions normal to the row.

15. A connector for terminating to a ribbon cable as recited in claim 14, wherein the intermediate sections of adjacent terminals in a row partially overlie each other and are spaced at least said predetermined distance apart.

16. A connector for terminating to a ribbon cable as recited in claim 14, wherein the insulation displacement section of each terminal includes an insulation displacement slot, said slots being offset from the axis of the mating portion of a respective terminal parallel to said row.

17. A connector for terminating to a ribbon cable as recited in claim 14, wherein the insulation displacement slot of terminals in said first row are offset from the axis of the mating portion of said terminals parallel to said first row in a first lateral direction.

18. A connector for terminating to a ribbon cable as recited in claim 16, wherein the offset of the insulation displacement slot from the axis of the mating portion of a terminal parallel to said row is one-half of the spacing between the axes of adjacent terminals in said row.

19. A connector for terminating to a ribbon cable as recited in claim 14, further comprising a second row of terminal receiving passages substantially parallel to said first row, said second row of passages having like terminals secured therein, wherein the insulation displacement sections of terminals in each row offset from the axis of the mating section toward the other row of contacts partially overlie each other and are spaced at least said predetermined distance apart.

20. A connector for terminating to a ribbon cable as recited in claim 19, wherein a terminal in said first row with the mating section displaced from the intermediate section in said first direction is identical to a terminal in said second row, with the mating section displaced from the intermediate section in said second direction, whereby the terminal in said second row is oriented 180 degrees relative to said terminal in said first row.

21. A connector for terminating to a ribbon cable as recited in claim 19, wherein the insulation displacement slot of terminals in said first row are offset from the axis of the mating portion of said terminals parallel to said first row in a first lateral direction and the insulation displacement slot of terminals in said second row are offset from the axis of the mating portion of said terminals parallel to said second row in a second lateral direction, said second lateral direction being opposite to said first lateral direction.

22. A connector for terminating to a ribbon cable as recited in claim 19, wherein a terminal in said first row, with the mating section displaced from the intermediate section in said second direction, is identical to a terminal in said second row, with the mating section displaced from the intermediate section in said first direction, whereby the terminal in said second row is oriented 180 degrees relative to said terminal in said first row.

23. A connector for terminating to a ribbon cable as recited in claim 14, wherein said intermediate section further comprises rearwardly facing insertion shoulders, whereby said second transition provides access to said insertion shoulders by displacing the insulation displacing section from the plane of the intermediate section.

24. A connector for terminating to a ribbon cable as recited in claim 14, wherein said intermediate section further comprises forwardly facing stop shoulders and said housing further comprises rearwardly facing stop shoulders for cooperating with said forwardly facing stop shoulders on the intermediate section, whereby upon insertion of a terminal into a passage, the forwardly facing stop shoulders on the intermediate section engage the rearwardly facing stop shoulders on the housing to position the terminal in said passage.

25. A connector for terminating to a ribbon cable as recited in claim 14, wherein every other conductor is adapted to be terminated to a terminal in said first row and the alternate conductors are adapted to be terminated to a terminal in said second row.

* * * * *